US008174814B2

(12) United States Patent
Yasuoka et al.

(10) Patent No.: US 8,174,814 B2
(45) Date of Patent: May 8, 2012

(54) WIRE ELECTRODE TYPE IONIZER

(75) Inventors: Koichi Yasuoka, Meguro-ku (JP); Youhei Miyata, Meguro-ku (JP); Nobuhiro Fujiwara, Tsukubamirai (JP); Satoshi Suzuki, Tsukubamirai (JP); Toshio Sato, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 225 days.

(21) Appl. No.: 12/265,852

(22) Filed: Nov. 6, 2008

(65) Prior Publication Data

US 2009/0135537 A1 May 28, 2009

(30) Foreign Application Priority Data

Nov. 22, 2007 (JP) ..... 2007-302843

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS

| | | | | |
|---|---|---|---|---|
| 4,253,852 | A * | 3/1981 | Adams | 96/58 |
| 5,008,594 | A * | 4/1991 | Swanson et al. | 315/111.81 |
| 7,697,259 | B2 * | 4/2010 | Chiou et al. | 361/231 |
| 2005/0270722 | A1 | 12/2005 | Gorczyca et al. | |
| 2007/0133145 | A1 * | 6/2007 | Sato et al. | 361/220 |
| 2008/0030919 | A1 * | 2/2008 | Botvinnik | 361/230 |

FOREIGN PATENT DOCUMENTS

| | | |
|---|---|---|
| JP | 10-189282 | 7/1998 |
| KR | 2000-0001060 A | 1/2000 |
| KR | 2002-0069504 | 9/2002 |

OTHER PUBLICATIONS

Korean Office Action issued Jul. 13, 2011, in Patent Application No. 10-2008-0114814 (with English-language translation).

* cited by examiner

*Primary Examiner* — Rexford Barnie
*Assistant Examiner* — Ann Hoang
(74) *Attorney, Agent, or Firm* — Oblon, Spivak, McClelland, Maier & Neustadt, L.L.P.

(57) ABSTRACT

An ionizer includes positive and negative wire electrodes each formed of a conductive wire with a circular cross section. The wire electrodes are arranged in parallel with each other, each having circumferential surfaces serving as a discharge surface on which a corona discharge occurs upon application of positive and negative high voltages for discharging positive and negative ions.

9 Claims, 4 Drawing Sheets

WIRE ELECTRODE TYPE IONIZER

TECHNICAL FIELD

The present invention relates to a wire electrode type ionizer for neutralizing various types of electrostatically charged works.

BACKGROUND ART

A generally employed ionizer applies high voltage to a needle electrode for generating ions by focusing the field to a top end of the needle electrode. The focusing of the electric field to the top end of the needle electrode is so intense that the top end of the electrode is likely to be deteriorated, thus degrading the performance for a long-term use.

As the needle electrode has a narrow ion generation region, the resultant ion generation amount is small. The ion generation amount may be increased by raising the voltage. However, the electric field at the top end of the needle electrode becomes so intense that generation of ozone with strong oxidative power is facilitated.

Patent Document, Japanese Unexamined Patent Application Publication No. 10-189282, discloses the ionizer for generating ions on a circumferential surface of the conductive wire to which high voltage has been applied for the purpose of solving the aforementioned problem of the needle electrode. The above-described ionizer is of AC type for generating positive and negative ions alternately by applying AC voltage to a single wire as the electrode. The use of such ionizer for generating the positive and negative ions using the single electrode causes the negative ion to have the same ionic concentration as that of the positive ion at lower voltage. When employing the aforementioned ionizer for alternately applying the positive and the negative voltages at the same level to the single wire electrode, generation amounts of the positive and the negative ions become different, thus disturbing the balance of the generated ions. The adjustment device for adjusting the positive and negative voltages is required to be added to the high voltage generator circuit for the purpose of realizing the good ionic balance by adjusting the ion generation amount. The positive ion generation amount may be increased by raising the positive voltage through the aforementioned adjustment. However, this may cause the problem resulting from the intense electric field around the electrode owing to the high voltage.

DISCLOSURE OF INVENTION

The present invention provides a wire electrode type ionizer capable of keeping a balance between positive and negative ions in a good condition by improving the electrode structure to increase the ion generation amount while suppressing such problem as facilitation of ozone generation as a result of raising the voltage applied to the electrode.

The present invention provides a wire electrode type ionizer of DC type or pulse DC type for generating positive and negative ions by applying positive and negative high voltages to a discharge electrode to generate a corona discharge. The discharge electrode includes a positive wire electrode and a negative wire electrode each formed of a wire with a circular cross section. Each circumferential surface of the wire electrodes is formed as a discharge surface for the corona discharge.

Preferably, a diameter of the negative wire electrode is larger than a diameter of the positive wire electrode. More preferably, the diameter of the negative wire electrode is larger than the diameter of the positive wire electrode. Specifically, it is preferable to set the diameter of the positive wire electrode to 50 μm, and the diameter of the negative wire electrode to 100 μm. The fluctuation of the electrode diameter of the aforementioned discharge electrode in the order of +/−10 μm is hardly influential.

Specifically, a housing of the ionizer is provided with a plurality of electrode cartridges each formed of an insulating material. The electrode cartridge is provided with an electrode holding member formed of an insulating member. The positive and negative wire electrodes are held by the electrode holding member at an interval in parallel with each other.

The electrode holding member includes a hollow portion, and two wires may be attached to the electrode holding member across the hollow portion to form the positive and the negative wire electrodes.

Preferably, the electrode cartridge has a front surface provided with a recess electrode storage portion. A pair of conducting fittings connected to a high voltage generator unit is provided on an inner bottom of the electrode storage portion. The electrode holding member is stored in the electrode storage portion to direct the positive and the negative wire electrodes to a front opening side of the electrode storage portion. The wire electrodes are electrically coupled with the high voltage generator unit via the pair of conducting fittings.

In the present invention, high voltages to be applied to the positive and the negative wire electrodes may be set to be within a range having a short charging time at a critical applied voltage or lower in which an ozone generation amount is sharply increased by raising an applied voltage. This makes it possible to suppress consumption of the wire electrode by ozone, thus prolonging the maintenance interval.

In the above-structured wire electrode type ionizer, the high voltage generator unit applies pulse DC type high voltages, that is, positive pulse high voltage and the negative pulse high voltage are applied alternately to the positive and negative wire electrodes. When the DC type high voltages, that is, the positive and the negative high voltages are applied to the positive and negative wire electrodes, the ion generation region is formed around both wire electrodes so as to be discharged. If each diameter of the wire electrodes is the same, the negative ion is generated more than the positive ion. So the diameter of the electrode which receives application of the negative high voltage is made larger than that of the electrode which receives application of the positive high voltage to adjust the ion generation amount, thus improving the ionic balance.

The electrode structure is improved by using the wire electrode to increase the ion generation amount while keeping the ionic balance between the positive and the negative ions without increasing the voltage applied to the electrode to facilitate the ozone generation. The present invention also suppresses the ozone generation amount, and prolongs the maintenance interval of the wire electrode.

BEST MODE FOR CARRYING OUT THE INVENTION

Figure 1:
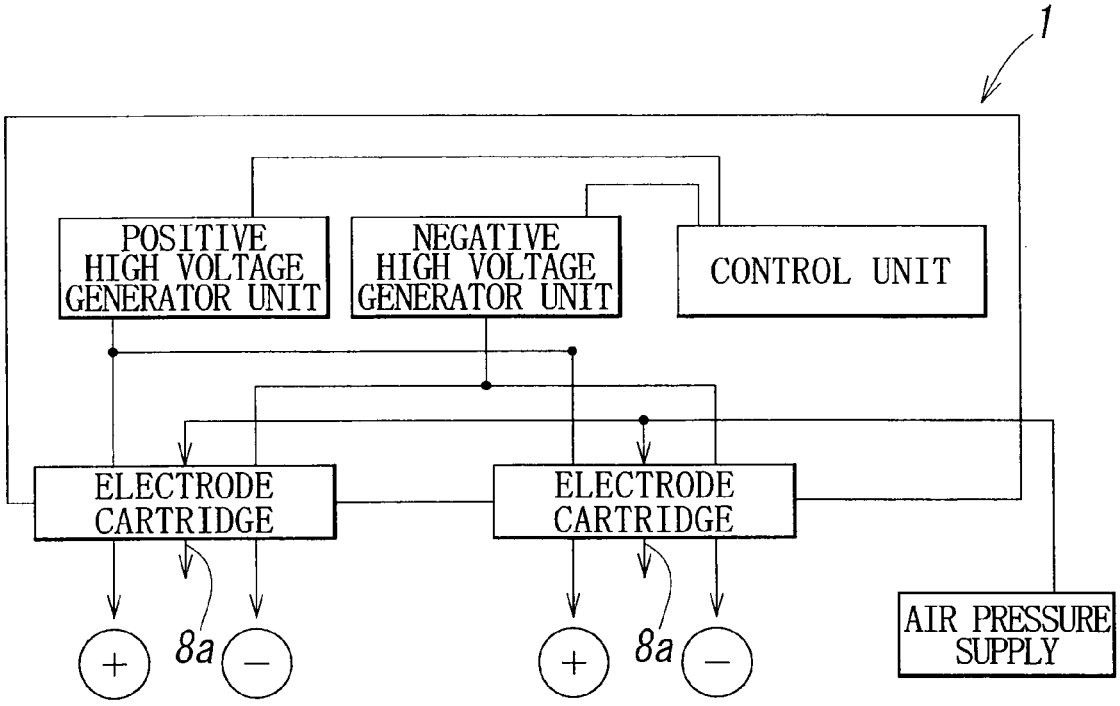
FIG. 1 is a block diagram showing an entire structure of a wire electrode type ionizer according to the present invention.

An embodiment of the present invention will be described referring to the drawings.

Figure 2:
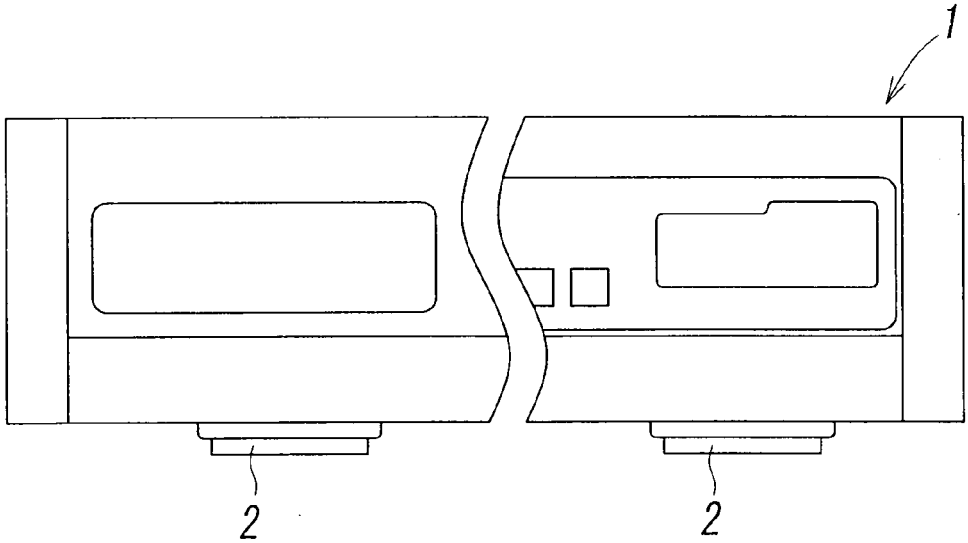
FIG. 2 is a front view partially showing the wire electrode type ionizer according to the present invention.
Figure 3:
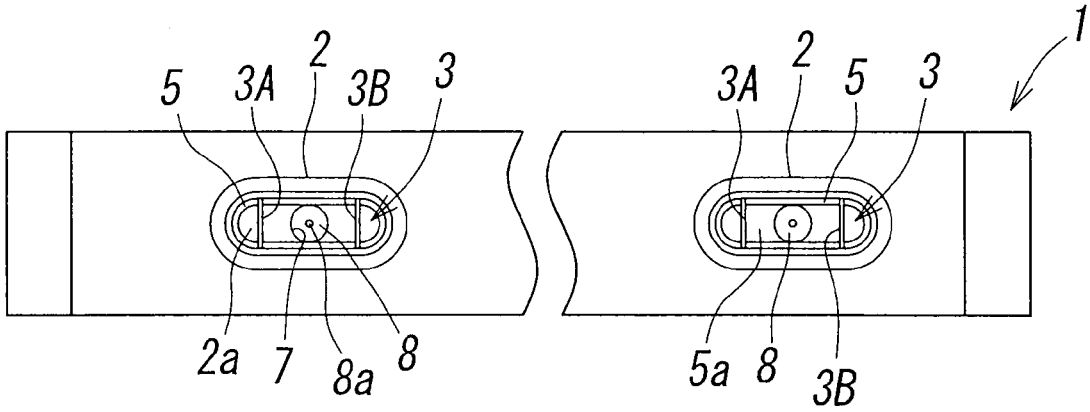
FIG. 3 is a bottom view partially showing the wire electrode type ionizer.
Figure 4:
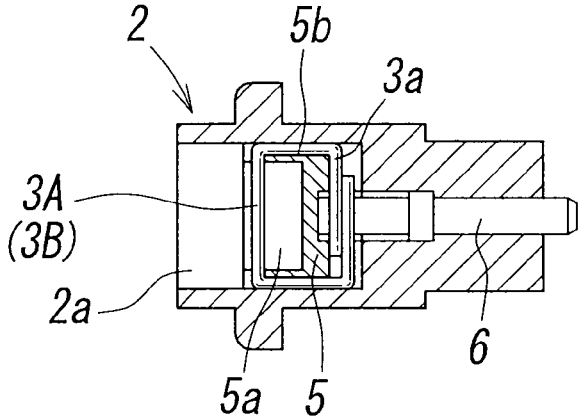
FIG. 4 is a sectional view showing a wire electrode mount portion of an electrode cartridge of the ionizer.

FIG. 1 is a block diagram schematically showing an entire structure of a wire electrode type ionizer according to the present invention. FIGS. 2 to 4 show a structures of essential portions of the embodiment.

The wire electrode type ionizer of DC type is provided with positive and negative high voltage generator units each having the voltage controlled by a control unit, and a discharge electrode 3 formed of positive and negative wire electrodes 3A and 3B in a housing 1. Positive and negative high voltages are applied from the high voltage generator units to the wire electrodes 3A and 3B so as to generate corona discharge, thus allowing the wire electrodes 3A and 3B to generate positive and negative ions.

Specifically, the ionizer has a horizontally thin and long hollow housing 1 as shown in FIGS. 2 and 3. A plurality of electrode cartridges 2 each having the discharge electrode 3 are detachably provided on the lower surface of the housing 1 at equal intervals along the longitudinal direction. Referring to FIGS. 3 and 4, the electrode cartridge 2 formed of an insulating material with substantially an oval shape as a plan view includes an electrode storage portion 2*a* with substantially an oval recess shape on the front surface (lower surface). An electrode holding member 5 for holding a pair of the wire electrodes 3A and 3B is stored in the electrode storage portion 2*a*.

The electrode holding member 5 is formed of an insulating material as a thin and long cup-like structure with substantially an oval shape, and includes a hollow portion 6*a* with substantially an oval recess shape in the front surface. Two conductive wires 3*a* are wound around the electrode holding member 5 to a short side in parallel with each other at a required interval. Portions of the wires 3*a* across the hollow portion 5*a* will be formed as the positive and negative wire electrodes 3A and 3B, respectively. The electrode holding member 5 is stored inside the electrode storage portion 2*a* of the electrode cartridge 2 while being directed to a front opening side of the electrode storage portion 2*a*. Each of the wire electrodes 3A and 3B has a circular cross section, and has a uniform thickness over the entire electrode. They are linearly applied to a top opening of the electrode holding member 5 such that the circular surface of the electrode becomes the discharge surface. Ions are discharged around the wire electrodes 3A and 3B from the circular discharge surface on which corona discharge is generated.

The hollow portion 5*a* does not have to be completely surrounded by a side wall. For example, at least one end of the hollow portion 5*a* in the longitudinal direction may be opened.

The pair of positive and negative wire electrodes 3A and 3B are electrically coupled with the positive and negative high voltage generator units via a pair of conducting fittings 6 disposed on an inner bottom of the electrode cartridge 2. Preferably, the electrode wire 3*a* has a surface formed of a gold plated tungsten. However, it is not limited to the one as described above. In order to wind the electrode wire 3*a* around the electrode holding member 5, a groove 5*b* with its width and depth sufficient to accommodate the wire is formed in the outer circumference. The winding may be performed while fitting the wire 3*a* with the groove 5*b*.

The electrode cartridge 2 includes a nozzle mount hole 7 which pierces through the center of an inner bottom wall of the electrode storage portion 2*a*. An air nozzle 8 connected to an air pressure supply via an air passage (not shown) in the housing 1 is disposed such that an air outlet 8*a* is directed to an intermediate portion between the positive wire electrode 3A and the negative wire electrode 3B. Accordingly, the positive wire electrode 3A and the negative wire electrode 3B are symmetrically positioned with respect to the air outlet 8*a*.

The air nozzle 8 has an air outlet 8*a* directed to the intermediate portion between the positive wire electrode 3A and the negative wire electrode 3B. However, it does not have to be opened at the position or in the direction as described above. It may further be disposed at more optimal position.

The positive and the negative wire electrodes 3A and 3B are connected to the positive and the negative high voltage generator units, respectively. They receive positive and negative high voltages through the pulse DC process or DC process for generating the corona discharge such that the positive and negative ions are discharged. When the positive high voltage is applied from the high voltage generator unit to the positive wire electrode through the pulse DC process, the negative electrode is controlled to be grounded. When the negative high voltage is applied from the high voltage generator unit to the negative wire electrode, the positive electrode is controlled to be grounded.

As described in reference to Patent Document 1, when the positive and negative high voltages each at the same level are applied to the wire electrodes 3A and 3B of the discharge electrode 3 each having the same diameter, the generation amount of the negative ion becomes larger than that of the positive ion. The difference in the generation amount between the positive ions and the negative ions may deteriorate the ionic balance. The discharge electrode 3 allows the wire electrode 3B to which the negative high voltage is applied to have a larger diameter than that of the wire electrode 3A to which the positive high voltage is applied.

The inventor of the present invention confirms that the negative ion generation amount becomes larger than the positive ion generation amount when the positive and negative voltages each at the same level are applied to the wire electrodes each with the same diameter from the experimental results as described below.

Figure 5:
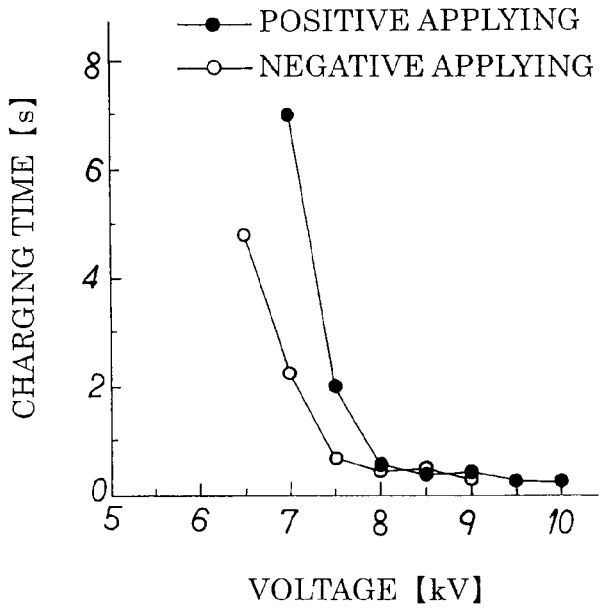
FIG. 5 is a graph showing a relationship between an applied voltage and a charging time when using wires each with the same diameter for positive and negative electrodes.

FIG. 5 shows the charging time when using the wires each having the diameter of 100 μm for both the positive and the negative wire electrodes. The charging time denotes the time taken for charging a charge plate (150 mm×150 mm) from 0V to 1000 V. The shorter the charging time becomes, the larger the ion generation amount becomes. Referring to the drawing, in the range of the applied voltage below 8 kV, the charging time upon application of the negative high voltage becomes shorter than the one upon application of the positive high voltage. Accordingly, the negative ion generation amount becomes large.

Figure 6:
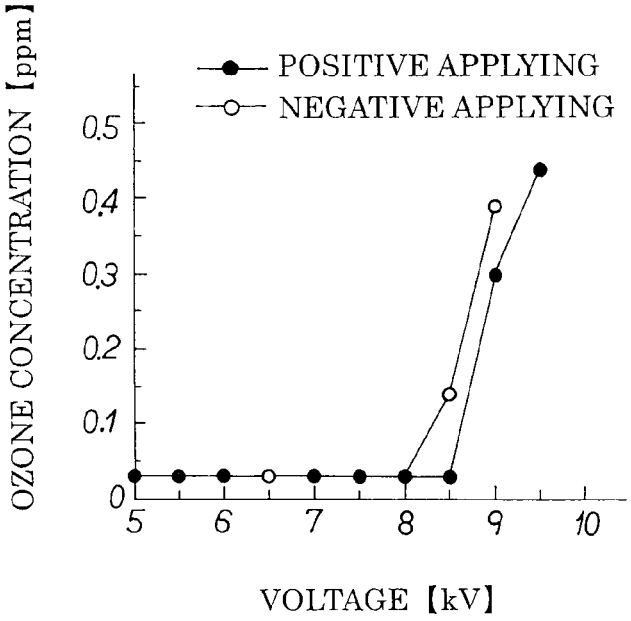
FIG. 6 is a graph showing a relationship between the applied voltage and a concentration of the generated ozone when using wires each with the same diameter for positive and negative electrodes.

FIG. 6 shows the concentration of ozone when using the wires each with the diameter of 100 μm for the positive and negative wire electrodes.

Referring to FIG. 5, when the applied voltage exceeds 8 kV, the positive and the negative ion generation amounts become the same. In the aforementioned state, the concentration of the generated ozone is sharply increased as shown in FIG. 6. The ionizer using the aforementioned wire electrodes is preferably operated in the condition where the voltage is set to be equal to or lower than the critical applied voltage at which the ozone concentration increases while adjusting both the positive and negative ion generation amounts.

Figure 7:
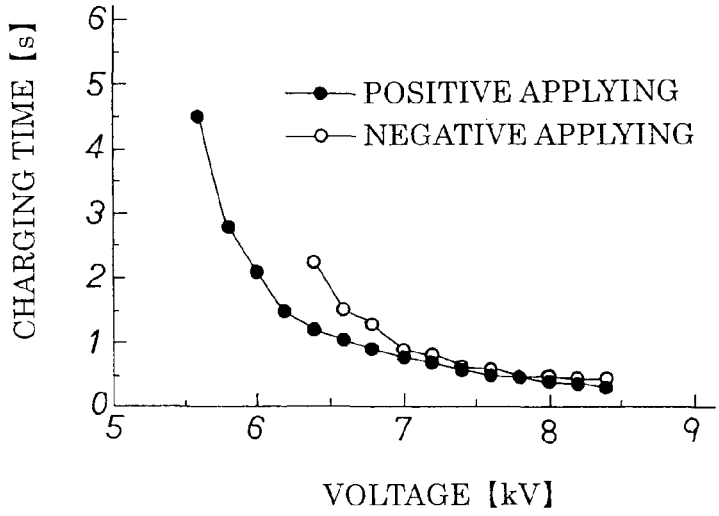
FIG. 7 is a graph showing a relationship between the applied voltage and the charging time when using different wires for the positive and the negative wire electrodes.
Figure 8:
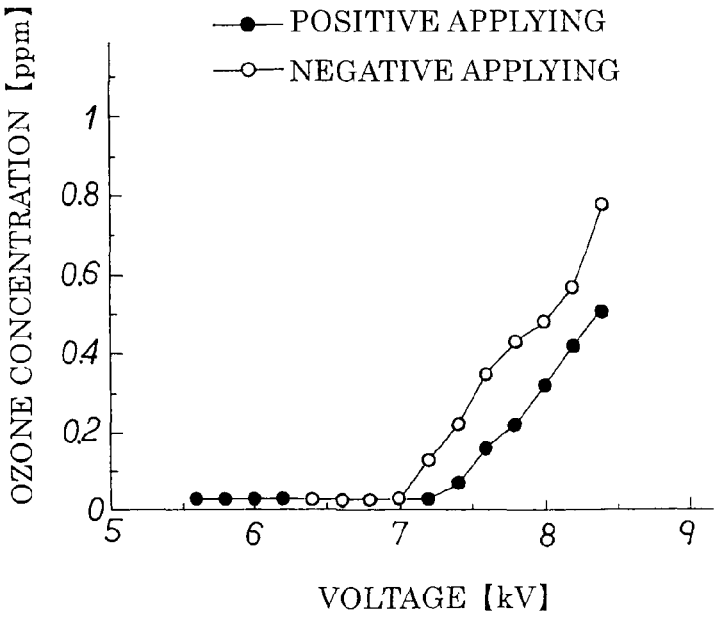
FIG. 8 is a graph showing a relationship between the applied voltage and the concentration of generated ozone when using different wires for the positive and the negative wire electrodes.

The influence of the difference in the diameter between the positive and the negative wire electrodes to the ion generation amount and the ozone generation amount will be described in reference to the experimental results as shown in FIGS. 7 and 8. In the experiment, the positive wire electrode with the diameter of 50 m and the negative wire electrode with the diameter of 100 μm were employed.

Referring to FIGS. 7 and 8, the ion generation amount becomes large, and the ozone generation amount becomes small in the range of the applied voltage from 6.5 kV to 7 kV. It is therefore preferable to operate the electrodes in the aforementioned range.

In the case where the positive and the negative wire electrodes each with the different diameter are used as described above, the critical applied voltage was observed at which the ozone generation amount sharply increases as the increase in the applied voltage. Meanwhile, the region having the short charging time and large ion generation amount exists at the voltage equal to or lower than the critical voltage. The applied voltage in the aforementioned range is suitable for the use of the ionizer.

In the experiment, the positive wire electrode with the diameter of 50 μm and the negative wire electrode with the diameter of 100 μm were employed for increasing the ion generation amount while suppressing the ozone generation amount and for balancing between the positive and the negative ion generation amounts. The experimental result shows the small difference between the positive charging time and the negative charging time compared with the case where each diameter of the positive and the negative wire electrodes is 100 μm. That is, the use of the wire electrodes each with the different diameter is effective for improving the ionic balance. As the optimal difference in the electrode diameter may differ in correlation with the applied voltage. The practical design of the ionizer is required to be performed in consideration with various designs and operation conditions. Generally, it is preferable to set the diameter of the negative wire electrode to be approximately twice the diameter of the positive wire electrode, and more specifically, 1.5 to 3 times larger. The diameter difference of the wire is set to be in an appropriate range, and then the positive and negative applied voltages are adjusted in a small range, or the adjustment unit for adjusting the voltage application times for the positive and the negative voltages to be different may be provided.

In the above-structured wire electrode type ionizer, when the positive and negative pulse high voltages are applied from the high voltage generator units to the positive and negative wire electrodes 3A and 3B alternately, or the positive and negative high voltages are applied to the positive and negative wire electrodes 3A and 3B, respectively, the ion generation region is formed around the wire electrodes such that the ions are discharged. If each diameter of the wire electrodes 3A and 3B is the same, the negative ion generation amount is larger than the positive ion generation amount. The diameter of the electrode to which the negative high voltage is applied is made larger than that of the electrode to which the positive high voltage is applied so as to adjust the ion generation amount, thus improving the ionic balance as shown in the experiment.

The high voltages applied to the positive and negative wire electrodes 3A and 3B may be set within a range having the short charging time at the critical applied voltage or lower in which the ozone generation amount is sharply increased by raising the applied voltage. Since generation of ozone is effectively suppressed, the consumption of the wire electrode by the ozone may be suppressed, thus prolonging the maintenance interval.

The invention claimed is:

1. A wire electrode type ionizer of DC type or pulse DC type for generating positive and negative ions by applying positive and negative high voltages, each at the same level, to a discharge electrode to generate a corona discharge, wherein:

the discharge electrode includes a positive wire electrode and a negative wire electrode each formed of a wire with a circular cross section;

each circumferential surface of the wire electrodes is formed as a discharge surface for the corona discharge, wherein a diameter of the negative wire electrode is larger than a diameter of the positive wire electrode;

an electrode holding member formed of an insulating material and being shaped to be elongated in one direction, wherein the electrode holding member comprises a hollow portion extending in a depth direction from an open end of the electrode holding member; and two wires comprising the positive wire electrode and the negative wire electrode, attached to the electrode holding member and crossing the hollow portion in parallel to one another and from one side to the other side of the hollow portion in a direction lateral to the direction of elongation of the electrode holding member and lateral to the depth direction of the hollow portion.

2. The wire electrode type ionizer according to claim 1, wherein a diameter of the negative wire electrode is approximately twice a diameter of the positive wire electrode.

3. The wire electrode type ionizer according to claim 2, wherein a diameter of the positive wire electrode is 50 μm, and a diameter of the negative wire electrode is 100 μm.

4. The wire electrode type ionizer according to claim 1, further comprising a plurality of electrode cartridges each formed of an insulating material;

wherein the electrode holding member is mounted in a recess shaped electrode storage portion of each electrode cartridge.

5. The wire electrode type ionizer according to claim 4, wherein:

the two wires surround the electrode holding member, wherein negative wire electrodes are comprised by the two wires crossing the hollow portion.

6. The wire electrode type ionizer according to claim 5, wherein:

the electrode cartridge has a front surface provided with a recess electrode storage portion;

a pair of conducting fittings connected to a high voltage generator unit is provided on an inner bottom of the electrode storage portion;

the electrode holding member is stored in the electrode storage portion to direct the positive and the negative wire electrodes to a front opening side of the electrode storage portion; and the wire electrodes are electrically coupled with the high voltage generator unit via the pair of conducting fittings.

7. The wire electrode type ionizer according to claim 4, wherein:

the electrode cartridge has a front surface provided with a recess electrode storage portion;

a pair of conducting fittings connected to a high voltage generator unit is provided on an inner bottom of the electrode storage portion;

the electrode holding member is stored in the electrode storage portion to direct the positive and the negative wire electrodes to a front opening side of the electrode storage portion; and the wire electrodes are electrically coupled with the high voltage generator unit via the pair of conducting fittings.

8. The wire electrode type ionizer according to claim 4, wherein high voltages to be applied to the positive and the negative wire electrodes are set to be within a range having a short charging time at a critical applied voltage or lower in which an ozone generation amount is sharply increased by raising an applied voltage.

9. The wire electrode type ionizer according to claim 1, wherein high voltages to be applied to the positive and the negative wire electrodes are set to be within a range having a short charging time at a critical applied voltage or lower in which an ozone generation amount is sharply increased by raising an applied voltage.

* * * * *